US005408961A

United States Patent [19]

Smith

[11] Patent Number: 5,408,961

[45] Date of Patent: Apr. 25, 1995

[54] IGNITION PLUG

[75] Inventor: Charles E. Smith, Polk County, Fla.

[73] Assignee: Innovative Automative Technologies Int. Ltd., Bartow, Fla.

[21] Appl. No.: 103,058

[22] Filed: Aug. 9, 1993

[51] Int. Cl.[6] ..... F02F 1/00

[52] U.S. Cl. ..... 123/169 R; 123/169 EL

[58] Field of Search ..... 123/169 R, 169 EL; 313/138, 139, 141

[56] References Cited

U.S. PATENT DOCUMENTS

| | | | |
|---|---|---|---|
| 1,253,570 | 1/1918 | Berry | 313/139 |
| 1,325,439 | 12/1919 | Dinger | 313/139 |
| 1,483,673 | 2/1924 | O'Connell | 313/125 |
| 1,495,499 | 5/1924 | Stanislawski | 313/125 |
| 1,666,853 | 4/1928 | Harris | 313/124 |
| 2,028,971 | 1/1936 | Falor | 313/125 |
| 2,048,481 | 7/1936 | Arnois | 313/11.5 |
| 2,299,924 | 10/1942 | Ost | 313/139 |
| 2,368,889 | 2/1945 | Setterblade | 123/169 EL |
| 2,487,535 | 11/1949 | Fernndez | 123/169 |
| 2,586,864 | 2/1952 | Rose | 313/140 |
| 2,894,162 | 7/1959 | Ignatjev | 313/141 |
| 3,970,885 | 7/1976 | Kasima | 313/141 |
| 4,023,058 | 5/1977 | Lara et al. | 313/139 |
| 4,267,481 | 5/1981 | Sauder | 313/139 |
| 4,268,774 | 5/1981 | Forkum, Jr. | 313/141 |
| 4,670,684 | 6/1987 | Kagawa et al. | 313/242 |
| 4,730,481 | 5/1987 | Sauder | 313/139 |
| 4,730,582 | 3/1988 | Lindsay | 123/169 MG |
| 4,916,354 | 4/1990 | Forkum, Jr. | 313/141 |
| 4,974,559 | 12/1990 | Nagaoka | 123/169 PA |
| 5,051,651 | 9/1991 | Kashiwara et al. | 313/139 |
| 5,280,214 | 1/1994 | Johnson | 313/139 |

FOREIGN PATENT DOCUMENTS

| | | | |
|---|---|---|---|
| 99824 | 4/1925 | Austria | 313/138 |
| 0167687 | 1/1986 | European Pat. Off. . | |
| 327115 | 6/1903 | France | 313/138 |
| 341069 | 7/1904 | France | 313/138 |
| 491008 | 5/1919 | France . | |
| 945476 | 5/1949 | France . | |
| 1001923 | 2/1952 | France | 123/169 EL |
| 1134688 | 4/1957 | France . | |
| 2479588 | 3/1980 | France . | |
| 2612346 | 9/1988 | France . | |
| 3407011 | 9/1985 | Germany | 313/141 |
| 162719 | 9/1983 | Japan | 123/169 EL |

*Primary Examiner*—Raymond A. Nelli

*Attorney, Agent, or Firm*—Dickstein, Shapiro & Morin

[57] ABSTRACT

An ignition plug having a center electrode tip and a substantially aerodynamically shaped ground electrode mounted coaxial to the center electrode tip. This construction substantially eliminates shielding and increases the ignition presentation and the aerodynamic flow of fuel in the gap and tip area. This provides greater power, increased gas mileage and reduced pollution. A circular ignition presentation is achieved by positioning the ground electrode around the center electrode forming a substantially uniform gap. Sparks will be emitted from the ground electrode to the center electrode throughout the gap. This provides a greater region of ignition thereby igniting more fuel. Conductive coatings are applied selectively to the inner surface of the ground electrode to control the distribution of electron flow about the gap to improve ignition uniformity. The electrode and insulator in the plug tip have decreased abrupt surface contour discontinuities to allow for aerodynamic flow of fuel. The gap is set permanently at the time of manufacture thereby eliminating problems with setting and maintaining the gap. The ground electrode is formed as an assembly having a base and the plug base includes a recess adapted to accept the base at various positions. Used with a cone-shaped center electrode, the gap can be adjusted by changing the position of the base in the recess prior to affixing the base in the recess.

26 Claims, 4 Drawing Sheets

FIG. 5
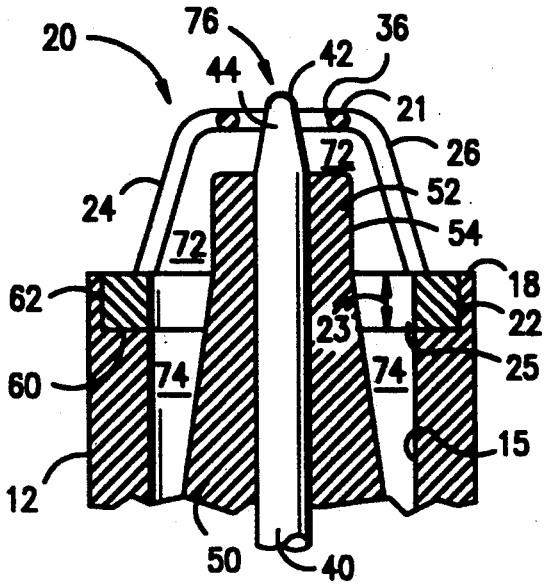
FIG. 6
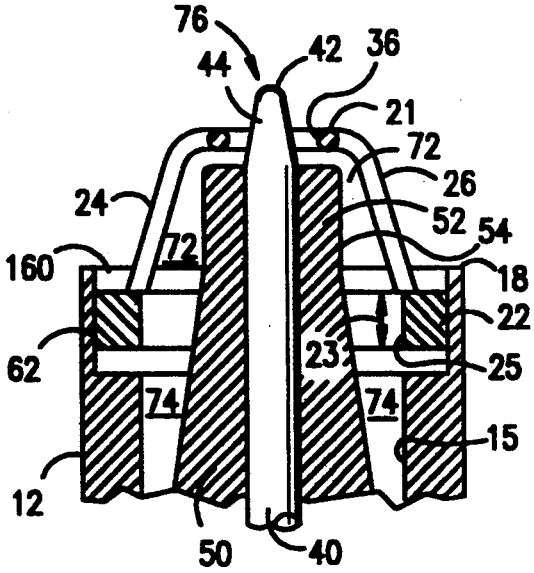
FIG. 7
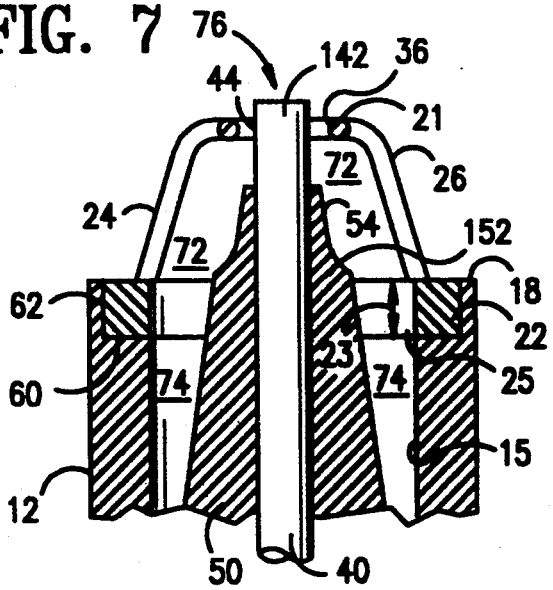
FIG. 8
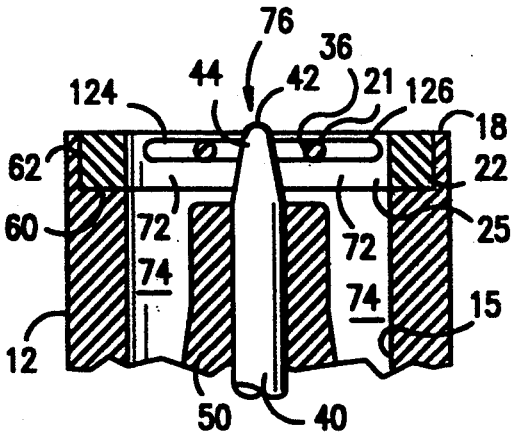
FIG. 9
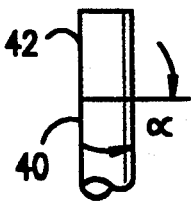
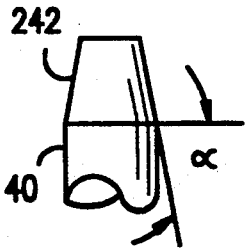
FIG. 10
FIG. 11
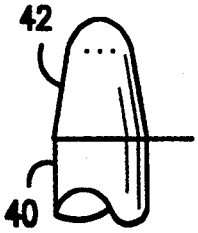
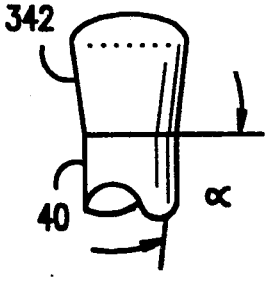
FIG. 12

IGNITION PLUG

BACKGROUND

The present invention relates to ignition systems for internal combustion engines in general and more particularly to an ignition plug for igniting the air/fuel mixture within the combustion chamber.

Ignition plugs, or spark plugs, are used in most internal combustion engines to provide relatively high voltage energy which is used to ignite the air/fuel mixture within the combustion chamber of the engine. The ignition plugs are mounted into the cylinder head and extend into the combustion chamber of the internal combustion engine. There is a terminal on the portion of the ignition plug external to the engine which is attached by a wire to the ignition system on one side and to a center electrode on the other. The portion of the ignition plug which is internal to the engine holds a ground electrode and the center electrode which are exposed to the combustion chamber. The electrodes are situated such that they face each other with a gap in between.

In general, when an engine is running, relatively high voltage energy is delivered to the ignition plug at the correct moment by the ignition system. When the voltage is applied across the gap, a charge builds on the center electrode causing electrons to cross the gap between the ground electrode and the charged center electrode, thereby producing sparks. In common negative ground ignition systems, the electron flow across the gap is from the ground (negative) electrode to the center (positive) electrode. The sparks ignite the air/fuel mixture which is contained within the combustion chamber, thereby providing the engine with power. The combustion process starts by the energy of the electron flow across the gap between the electrodes igniting the fuel-air mixture that passes the ignition plug when it is firing. Energy is released from the resulting chemical reaction between the fuel and oxygen. This energy is in the form of high temperature combustion product molecules moving at a high speed. These molecules collide with adjacent air/fuel mixture and transferring sufficient heat energy to ignite the mixture. In this way the combustion quickly spreads through the combustion chamber. The spread of combustion is aided by the high velocities that the air/fuel mixture experiences as a result of being introduced into the combustion chamber and being compressed by the piston.

Typically, however, a substantial portion of the fuel within the combustion chamber is not burned. This is a result of a variety of factors including shielding, limited ignition presentation and poor aerodynamic flow of the air/fuel mixture within the combustion chamber.

Shielding occurs when the ground electrode itself or some other structure blocks some of the air/fuel mixture from being in the direct path of the propagation of combustion initiated by the ignition. Shielding is a common disadvantage in ignition plugs having a ground electrode that is bent over the end of the center electrode thereby blocking the air/fuel mixture contained behind the ground electrode from igniting.

A related disadvantage common in such ignition plugs is that there is a limited region of ignition presentation available for ignition of the air/fuel mixture. This is because there is a small gap area which limits the ignition to a very small region near the plug tip. This limited ignition region limits the opportunity that the fuel has of coming into contact with the ignition and thereby limits the amount of fuel that can be ignited.

Another disadvantage of conventional ignition plugs is that they are not aerodynamically designed. Air/fuel mixture and burning fuel circulates about the combustion chamber at high velocities during ignition. The combustion chamber itself has a cylindrically shaped, smooth interior surface which allows for the aerodynamic movement of air/fuel mixture. Known ignition plugs, however, contain abrupt or sharp surfaces, edges and discontinuities in the tip area which have poor aerodynamics and impede the movement of air/fuel mixture. This is particularly a problem considering that the ignition is located within the tip area, and the air/fuel should flow most freely there to guarantee that most of it is ignited.

Due to the shielding, limited ignition presentation and non-aerodynamic design, only some of the fuel is ignited. This makes the power output of the engine less than it would be if all of the fuel were burned. Moreover, the engine is less efficient and, therefore, does not get the fuel economy it would otherwise get. A further result of the inefficient burn is that the fuel which is not burned is forced out of the combustion chamber along with the exhaust gasses. Unburned fuel is a worse pollutant than burned fuel and, therefore, an engine which does not burn all of the fuel during ignition creates more pollution than an efficient engine which does.

Another disadvantage occurring with conventional ignition plugs is in setting the gap. Typically, the gap is set by manually bending the ground electrode to obtain the proper gap. The bending process is often imprecise and/or often becomes inadvertently misaligned after prolonged engine operation.

In U.S. Pat. No. 1,325,439, a spark plug is described that has a ring-shaped ground electrode. This construction improves the presentation of spark by allowing spark generation in a circle between the ground and center electrodes. Moreover, this configuration creates less shielding than a conventional plug in the axial direction. However the semicircular crossectional shape of the ground electrode presents a flat surface towards the center electrode and has significant surface discontinuities at the juncture of the flat inner surface and the rounded outer surface. This structure results in poorer aerodynamics of the air/fuel mixture and particularly of the combustion products propagating away from the gap.

In U.S. Pat. No. 1,495,499, a spark plug is described that has a coil-shaped ground electrode and a star-shaped center electrode providing four gaps to generate sparks in four discrete locations. The ground electrode is round in crossection, but has discontinuities at its free end. This and the structure of the arms of the center electrode decrease the aerodynamics of the plug tip.

U.S. Pat. No. 1,666,853 describes a spark plug having a ring-shaped ground electrode. The circular electrode is positioned at an angle to the center electrode which results in a varying gap dimension and decreased spark presentation.

Accordingly there is a need in the art for an ignition plug that will provide improved aerodynamics, spark presentation and less shielding.

SUMMARY

The present invention alleviates to a great extent the disadvantages of the prior art by providing a ignition plug having a cone-like shaped center electrode tip and a ground electrode which is substantially aerodynamically shaped and is mounted coaxial to the center electrode tip. This construction substantially eliminates shielding while, at the same time, increases the ignition presentation and the aerodynamic flow of fuel in the gap and tip area. This results in greater power output for the engine, increased gas mileage and reduced pollution. In one aspect of the present invention, the ground electrode is positioned around the side of the center electrode, thereby reducing the effects of shielding. While this arrangement still results in some shielding, its effects are limited to shielding the ignition from some of the air/fuel mixture located at the sides of ground electrode, a location holding only a small portion of the air/fuel mixture. There is nothing blocking the ignition from exposure to the piston end of the combustion chamber where most of the fuel is held.

In another aspect of this invention, a circular ignition presentation is achieved by positioning the ground electrode around the center electrode forming a substantially uniform gap. Radial presentation of sparks will be emitted from the ground electrode to the center electrode throughout the gap. This provides a greater region of ignition and, therefore more fuel will be ignited by the spark.

In another aspect of the invention, conductive coatings are applied selectively to the inner surface of the ground electrode to control the distribution of electron flow about the entire region of the gap to improve ignition uniformity.

In another aspect of the invention the electrode and insulator in the plug tip are formed with decreased abrupt surface contour discontinuities to allow for the aerodynamic flow of fuel about the tip area and gap.

In another aspect of the invention is that the gap is set permanently at the time of manufacture thereby eliminating problems with setting and maintaining the gap.

In yet another aspect of the invention, the ground electrode is formed as an assembly having a base and the plug base includes a recess adapted to accept the base at various positions. Used with a cone-shaped center electrode, the gap can be adjusted by changing the position of the base in the recess prior to affixing the base in the recess.

It is an object of the present invention to provide a ignition plug which causes a quicker and more complete burning of fuel.

It is another object of the present invention to provide an ignition plug with the foregoing advantages and that generates an ignition which extends through a radial region.

It is yet another object of the present invention to provide an ignition plug with the foregoing advantages and that generates an ignition which is distributed substantially uniformly across the gap.

It is a further object of the present invention to provide a ignition plug with the foregoing advantages and that has improved aerodynamic surfaces.

It is still another object of the present invention to provide a ignition plug with the foregoing advantages and which has a gap which is permanently set.

With these and other objects, advantages and features of the invention that may become apparent, the nature of the invention may be more clearly understood by reference to the following detailed description of the invention, the appended claims and the several drawings attached hereto.

BRIEF DESCRIPTION OF THE DRAWINGS

FIG. 5 is a cross-sectional view taken along line V—V of FIG. 4.

FIG. 6 is a view like FIG. 5 showing an alternate embodiment of the plug base.

FIG. 7 is a view like FIG. 5 showing an alternate embodiment of the insulator tip.

FIG. 8 is a view like FIG. 5 showing an alternate embodiment employing recessed electrode positions.

FIG. 9 is a side view of the center electrode tip showing a truncated cone portion having a cone angle of ninety degrees.

FIG. 10 is a view like FIG. 9 showing a truncated cone portion having a cone angle of less than ninety degrees and a flattened tip.

FIG. 11 is a view like FIG. 9 showing a truncated cone portion having a rounded tip.

FIG. 12 is a view like FIG. 9 showing a truncated cone portion having a cone angle of greater than ninety degrees and a rounded tip.

DESCRIPTION OF PREFERRED EMBODIMENTS

Figure 1:
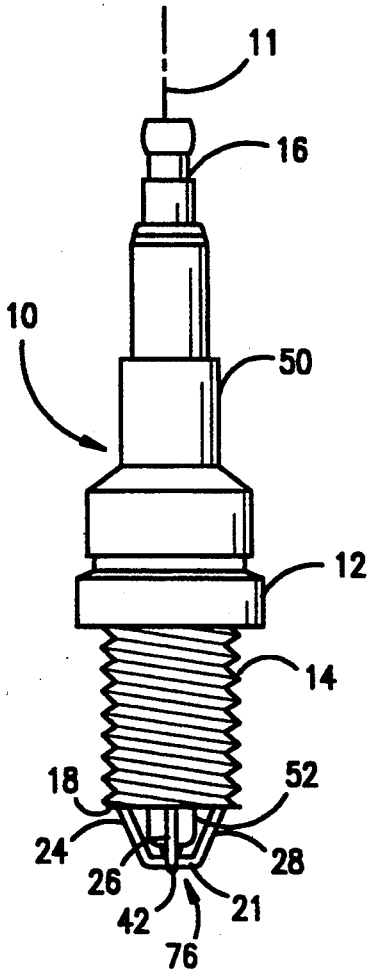
FIG. 1 is a side elevational view of a first embodiment of an ignition plug according to the present invention.
Figure 2:
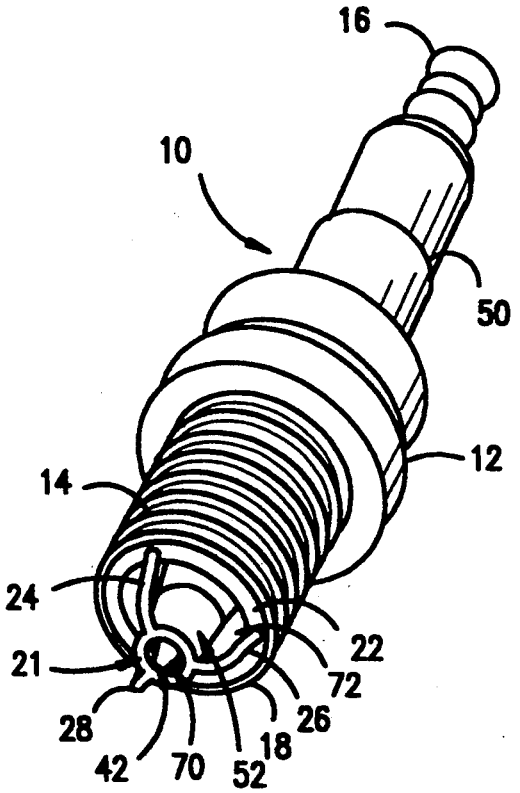
FIG. 2 is a perspective bottom view of the ignition plug of FIG. 1.
Figure 3:
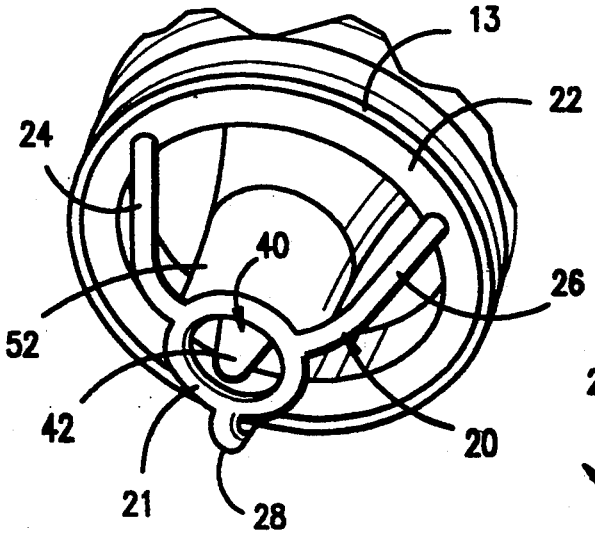
FIG. 3 is a view like FIG. 2 showing an enlarged view of the ignition plug.
Figure 4:
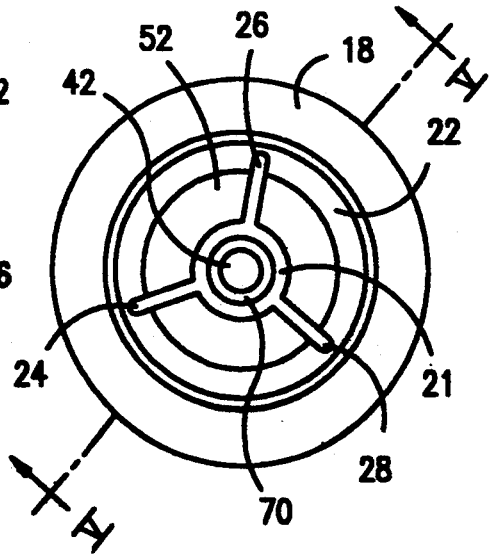
FIG. 4 is a piston end view of the ignition plug of FIG. 1.

Refer now to FIGS. 1 through 5 there being shown a ignition plug, generally designated by reference numeral 10, according to the preferred embodiment of the present invention. As shown, the ignition plug 10 includes a base 12 having a threaded portion 14 for securing the ignition plug 10 to the engine. A center electrode 40 extends through the length of the ignition plug 10. The center electrode 40 is surrounded by an insulator 50 to electrically insulate it from the base 12. At its upper or wire end (not shown), the center electrode 40 is in electrical contact with a terminal 16 adapted to couple to a ignition plug wire (not shown). At its lower or piston end 42 the center electrode 40 extends out of the tip 52 of the insulator 50.

The center electrode 40 is substantially cylindrical in cross-section and is coaxial to the longitudinal axis 11 of the ignition plug 10. The center electrode is composed of a material which is durable and has a high melting temperature so that it has a long operating life. The center electrode tip 42 is substantially cone shaped. This shape gives the center electrode a rounded and aerodynamic outer surface 44 over which the air/fuel mixture can flow freely. The outer surface 44 of the center electrode tip 42 is coated with platinum, a highly conductive material, to improve conductivity. Moreover the platinum coating has a high melting temperature and increases the life of the coated surface.

The center electrode 40 is held in place by the electrode insulator 50 which extends from the terminal 16 the plug piston end 76. The center electrode tip 42 extends beyond the electrode insulator tip 52 and is exposed.

As shown in FIG. 5, a recess 74 is defined by the inner surface 15 of the plug base 12, the outer surface 54 of the electrode insulator 50 and the end 18 of the plug base 12. Air/fuel mixture can flow through the recess 74 during ignition. The dimensions of the recess 74 affect the temperature of which the plug operates during use. The recess 74 may be sized to achieve various "heat ranges" for a given plug configuration.

A ground electrode assembly 20 is attached to the end 18 of the plug base 12. The ground electrode assembly 20 includes an electrode ring 21 which is electrically connected to an electrode base 22 by a plurality of ground electrode legs 24, 26 and 28.

The ground electrode base 22 is electrically connected to the end of the plug base 18 at the ground electrode slot 60. This last connection is accomplished by a resistance welding process in the ground electrode weld area 62. As shown in FIG. 5, the depth of the ground electrode slot 60 is equal to the depth 23 of the ground electrode base 22 so that the ground electrode base 22 its flush with the end 18 of the plug base 12.

The assembly 20 is sized and shaped such that the ground electrode ring 21 is positioned substantially coaxial to the center electrode tip 42 and substantially coaxial to the axis 11 of the ignition plug 10. The center electrode tip 42 extends entirely through the ground electrode ring 21 into the combustion chamber of the engine. The diameter of the ground electrode ring 21 is larger than the diameter of the center electrode tip 42 thereby forming an ignition gap 70 between the two electrodes. Because the center electrode tip 42 extends entirely through the ground electrode ring 21, the ignition will travel across the ignition gap 70 from the inner surface 36 of the ground electrode ring 21 to the side of the center electrode tip 42.

The ground electrode ring 21 has a circular cross section and a rounded, smooth surface without significant abrupt surface irregularities, so as to allow for the aerodynamic flow of air/fuel mixture across its surfaces. The ground electrode legs 24, 26 and 28 are also circular in cross-section allowing for the aerodynamic flow of air/fuel mixture.

The components of the ground electrode assembly are constructed of a conductive material which is durable, has a high melting temperature and a long operating life. The assembly 20 may be made by common casting methods.

Refer now to FIG. 6. The ground electrode slot 160 is lathed out to be greater than the depth 23 of the ground electrode base 22. This allows the ground electrode assembly 20 to be press fit axially within the ground electrode slot 160 such that the ground electrode ring 21 moves axially along the stationary center electrode tip 42. This movement in conjunction with cone shape of the center electrode tip 42 allows adjustment of the ignition gap 70. By resistance welding the ground electrode base 22 at the proper depth within the ground electrode slot 160, the ignition air gap 70 can be set precisely for each ignition plug during manufacture. This removes the imprecision of setting the ignition gap 70 by hand as in conventional prior art designs. Moreover, since the ground electrode ring 21 is permanently welded into position, the ignition gap 70 remains stable even after extensive use.

Refer now to FIG. 7. The electrode insulator tip 152 is tapered to form a cone to allow for the aerodynamic flow of air/fuel mixture about the tip area 72 and further guarantee that more of the fuel will be exposed to the ignition. Also the center electrode tip 142 in this example is squared off and has a ninety degree cone angle.

Refer now to FIG. 8. The center electrode tip 42 ends substantially flush with the end 18 of the plug base 12. The ground electrode legs 124,126 and 128 are positioned such that the ground electrode ring 21 is located substantially within the recess 74. This configuration is desirable for applications in which there is not enough clearance within the combustion chamber for the electrodes to extend significantly therein.

Figure 20:
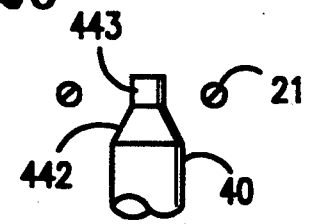
FIGS. 20 and 21 are views like FIG. 9 showing center electrodes with two cone portions.
Figure 21:
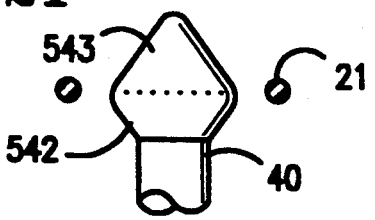

Refer now to FIGS. 9 through 12, 20 and 21, all of which demonstrate possible shapes for the center electrode tip 42. In FIG. 9, the center electrode tip 42 has a cone angle, alpha, equal to ninety degrees. In FIG. 10, the center electrode tip 242 has a cone angle, alpha, less than ninety degrees and a flattened end. The center electrode tip 42 shown in FIG. 11 also has a cone angle, alpha, less than ninety degrees, but has a rounded end. In FIG. 12, the center electrode tip 342 has a cone angle greater than ninety degrees as well as diameter that is substantially greater than the diameter of the rest of the center electrode. In FIGS. 20 and 21, the electrode includes two truncated cone portions. In FIG. 20, portion 442 has an acute cone angle and portion 443 has a right cone angle. In FIG. 21, portion 542 has an obtuse cone angle and portion 543 has an acute cone angle.

The cone angle will determine the mean direction of spark presentation between the two electrodes. For a cone angle, alpha, of 90 degrees, the mean direction of presentation should be normal to the axis 11. As the cone angle, alpha, decreases, the mean direction of spark presentation shifts towards the insulator, to be normal to the center electrode surface 44.

Figure 13:
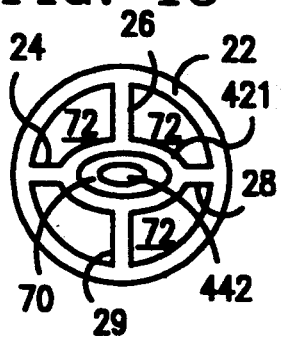
FIG. 13 is a bottom view of an alternate embodiment having elliptical shaped electrodes.

In FIG. 13, an elliptical ring 421 and a matching elliptical electrode 442 are employed. Although a circular electrode is most versatile, a noncircular curve will provide improved spark presentation and aerodynamics over conventional prior art designs.

Figure 14:
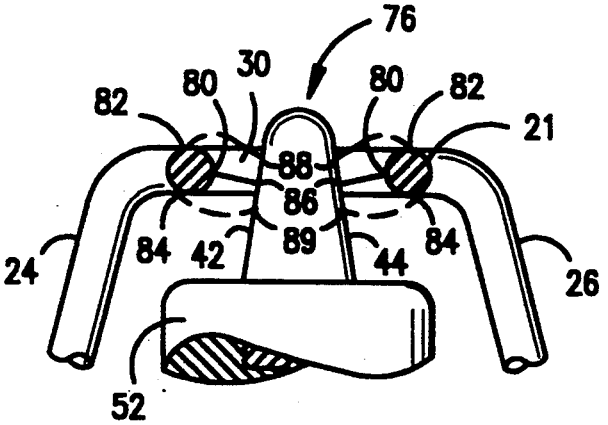
FIG. 14 is a partial cross-sectional view of the piston end of the center electrode and ground electrode showing the coating and ignition paths.
Figure 15:
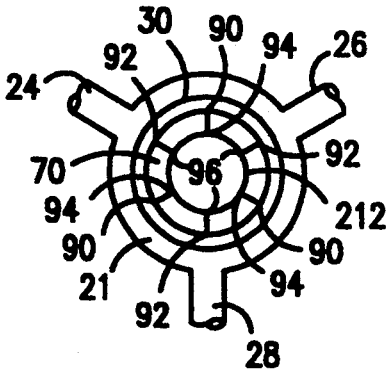
FIG. 15 is a bottom view of the ignition plug of FIG. 14.

Refer now to FIGS. 14 and 15. The inner surface 36 of the ground electrode ring 21 is coated with platinum. The platinum coating 30 substantially facilitates the process by which sparks jump the gap 70 between the inner surface 36 of the ground electrode and the outer surface 44 of the center electrode tip. Electrons will first cross the gap 70 along the path of least resistance between the electrodes. In FIG. 14, the path of least resistance for electrons to ignition between the two electrodes occurs at the point where the inner surface of the ground electrode ring 36 comes closest to the outer surface of the center electrode tip 44 and is defined by the line connecting line 80 to line 86. Lines 80 and 86 are actually circles, and, therefore, the area between the two is a disk providing a 360 degree area of sparking. Because of the magnitude of the voltage cross the gap 70, electrons traverse the gap 70 along paths other than the path of least resistance. Indeed, electrons flow through a region that is donut shaped between the two electrodes. However, the voltage necessary to achieve electron flow across the gap is not uniform throughout donut region. The voltage required is greater along paths where the electrical resistance is higher. Along the periphery of the electron flow region, such as between coating 30 edge 82 and line 88 or between coating edge 84 and line 89 the voltage must reach a higher magnitude before electron flow commences.

As the voltage across the gap 70 is increased, although slightly delayed, the temperature of the resulting ignition also increases. A hotter ignition ignites substantially more fuel substantially more rapidly than a cool ignition. Since the path of least resistance is defined between lines 80 and 86, i.e., the shortest gap distance, it experience relating cooler ignition. However, the region defined between lines 82 to 88 and lines 84 to 89, representing the longer gap distances, have relatively hotter ignition within the gap region. Viewing the region during actual ignition, one can observe a darker color in the cold regions and a brighter color in the hot regions. With reference to FIG. 15, such cold regions also occur radially between the inner surface 36 of the ground electrode ring 22 opposite the ground electrode legs 24, 26 and 28 and the outer surface 44 of the center electrode tip 42. These cool regions, represented by lines between points 92 and 96, occur proximate the ground electrode legs 24, 26 and 28 because the electrical resistance through the electrode 20 is the least at these points. The regions of substantially higher voltage and higher ignition temperature are represented by the lines connecting points 90 and 94.

Figure 16:
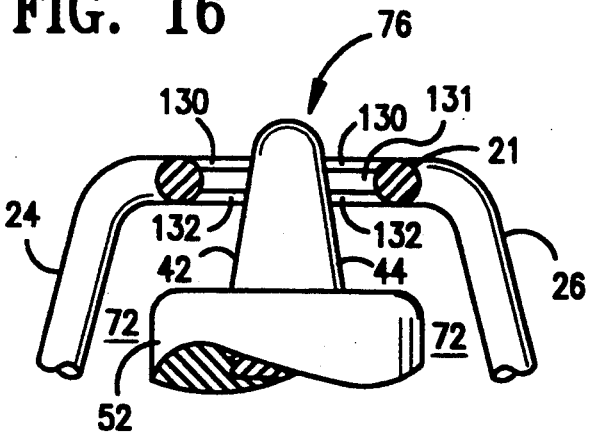
FIG. 16 is a view like FIG. 14 showing horizontal gaps in the coating.
Figure 17:
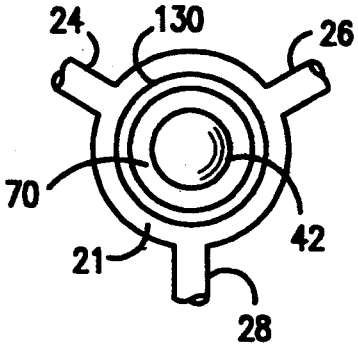
FIG. 17 is a bottom view of the ignition plug of FIG. 16.

Refer now to FIGS. 16 and 17. In this embodiment, a gap 131 is provided in the platinum coating between a top coating strip 130 and a bottom coating strip 132. Providing the gap 131 results in a lower conductivity and a higher gap voltage in the relatively cool region. This makes the relatively cool region hotter than would otherwise occur and results in a substantially more uniformly hot sparking which ignites substantially more of the fuel.

Figure 18:
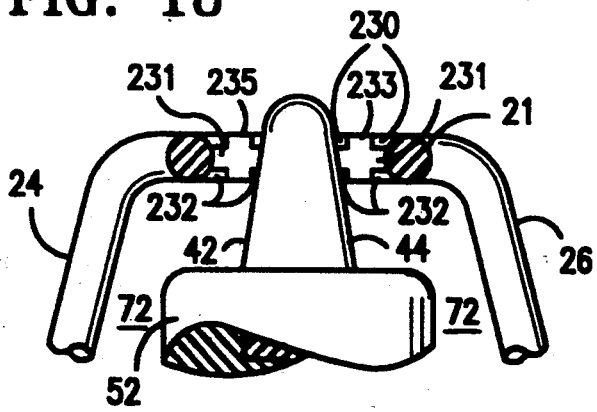
FIG. 18 is a view like FIG. 14 showing both horizontal and vertical gaps in the coating.
Figure 19:
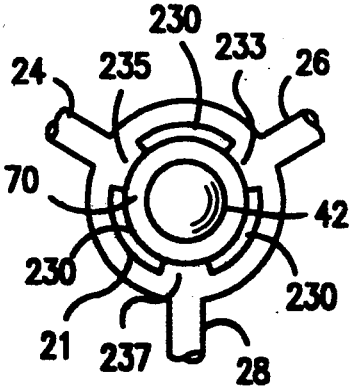
FIG. 19 is a bottom view of the ignition plug of FIG. 18.

Refer now to FIGS. 18 and 19. In this embodiment, there is both a horizontal gap 231 in the conducting coating (as was shown in FIGS. 16 and 17) and vertical gaps 233, 235 and 237 in the conducting strip, leaving a vertically gapped top conducting strip 230 and a vertically gapped bottom conducting strip 232. The horizontal gap 231 in the conducting strip compensates for the horizontal cool region as discussed above. The radial gaps 233, 235, 237 in the conducting strip even out the radial concentration of sparks to be more uniformly distributed about the entire 360 degree inner surface 36 of the ground electrode ring 21.

In a comparison test, a vehicle with a four cycle, four liter gasoline engine was run at about 50 to 55 miles per hour at about 85 to 95 degrees Fahrenheit ambient air temperature and 70 to 90 percent relative humidity. The vehicle was run 470 miles with market plugs and the same distance with test plugs constructed according to FIG. 7, but with an insulator tip 54 like shown in FIG. 5. The vehicle with the market plugs used. 26.8 gallons of gasoline. The same vehicle with the test plugs used only 20.4 gallons.

Although preferred embodiments are specifically illustrated and described herein, it will be appreciated that modifications and variations of the present invention are covered by the above teachings and within the purview of the appended claims without departing from the spirit and intended scope of the invention.

What is claimed as new and desired to be protected by Letters Patent of the United States is:

1. An ignition plug for igniting a fuel-air mixture in a combustion chamber, comprising:

a cone-like shaped center electrode tip and a ground electrode having an inner surface, at least a portion of said inner surface being substantially aerodynamically shaped and mounted coaxial to said center electrode tip;

wherein said center electrode includes a truncated cone portion; and wherein said truncated cone portion is rounded at its tip.

2. An ignition plug for igniting a fuel-air mixture in a combustion chamber, comprising:

a cone-like shaped center electrode tip and a ground electrode having an inner surface, at least a portion of said inner surface being substantially aerodynamically shaped and mounted coaxial to said center electrode tip;

wherein said center electrode includes a truncated cone portion; and wherein said truncated cone portion has a cone angle equal to ninety degrees.

3. An ignition plug for igniting a fuel-air mixture in a combustion chamber, comprising:

a cone-like shaped center electrode tip and a ground electrode having an inner surface, at least a portion of said inner surface being substantially aerodynamically shaped and mounted coaxial to said center electrode tip, wherein said center electrode is elliptical in cross-section.

4. An ignition plug for igniting a fuel-air mixture in a combustion chamber, comprising:

a cone-like shaped center electrode tip and a ground electrode having an inner surface, at least a portion of said inner surface being substantially aerodynamically shaped and mounted coaxial to said center electrode tip, wherein said ground electrode is circular in cross-section.

5. An ignition plug for igniting a fuel-air mixture in a combustion chamber, comprising:

a cone-like shaped center electrode tip and a ground electrode having an inner surface, at least a portion of said inner surface being substantially aerodynamically shaped and mounted coaxial to said center electrode tip, wherein said ground electrode is elliptical in cross-section.

6. An ignition plug for igniting a fuel-air mixture in a combustion chamber, comprising:

a cone-like shaped center electrode tip and a ground electrode having an inner surface, at least a portion of said inner surface being substantially aerodynamically shaped and mounted coaxial to said center electrode tip, wherein said ground electrode includes a ring supported by a plurality of legs; and wherein said legs extend to be connected to a ring shaped base.

7. An ignition plug as in claim 6 wherein said base is circular.

8. An ignition plug as in claim 7 wherein said plug includes a slot sized to accept and support said base.

9. An ignition plug as in claim 8 wherein said slot has a depth substantially the same as the depth of said base such that said base when seated in said slot sits substantially flush to the end of said slot.

10. An ignition plug as in claim 8 wherein said slot is deeper than the depth of said base such that said base can be positioned at various locations to position said ground electrode ring at various distances from said center electrode.

11. An ignition plug as in claim 10 wherein said base is resistance welded into said slot.

12. An ignition plug for igniting a fuel-air mixture in a combustion chamber, comprising:

a cone-like shaped center electrode tip and a ground electrode having an inner surface, at least a portion of said inner surface being substantially aerodynamically shaped and mounted coaxial to said center electrode tip, wherein said ground electrode includes a ring supported by a plurality of legs; and wherein said inner surface of said ground electrode is coated with conducting material.

13. An ignition plug as in claim 12 wherein said coating has a horizontal gap about its middle.

14. An ignition plug as in claim 12 wherein said coating has vertical gaps opposite the area where said legs are attached.

15. An ignition plug as in claim 12 wherein said coating has both horizontal and vertical gaps.

16. An ignition plug for igniting a fuel-air mixture in a combustion chamber, comprising:

a cone-like shaped center electrode tip and a ground electrode having an inner surface, at least a portion of said inner surface being substantially aerodynamically shaped and mounted coaxial to said center electrode tip, wherein said center electrode is coated with conducting material.

17. An ignition plug for igniting a fuel-air mixture in a combustion chamber, comprising:

a center electrode including a substantially cylindrical tip;

a ground electrode including an electrode ring and a plurality of legs coupled at one end to said ring;

wherein said electrode ring has a generally circular cross-section and includes a smoothly curved inner surface facing said center electrode so as to allow for aerodynamic flow of the fuel-air mixture across said inner surface, and wherein said electrode ring defines a plane generally perpendicular to a longitudinal axis of said center electrode.

18. An ignition plug as in claim 17, further comprising a base ring, wherein said legs are coupled at another end to said base ring.

19. An ignition plug as in claim 18, wherein said electrode ring, said base ring and said legs are formed as an integral casting.

20. An ignition plug as in claim 17 wherein said electrode ring extends entirely around said center electrode.

21. An ignition plug as in claim 20 wherein said inner surface of said electrode ring is substantially equidistant from the outer surface of said center electrode.

22. An ignition plug as in claim 17 wherein said legs have a generally circular cross-section.

23. An ignition plug as in claim 22 wherein said plug includes a slot sized to accept and support said base ring.

24. An ignition plug as in claim 23 wherein said base is welded into said slot.

25. An ignition plug as in claim 17 wherein said tip extends to the plane defined by said electrode ring.

26. An ignition plug as in claim 17 wherein said tip extends beyond said electrode ring in the direction towards the combustion chamber.

* * * * *